United States Patent [19]

Bengtsson et al.

[11] 4,195,364

[45] Apr. 1, 1980

[54] GARMENT FOR USE IN VIGOROUS PHYSICAL ACTIVITIES

[75] Inventors: Anders G. Bengtsson, Borås; Kjell Eng, Mullsjö, both of Sweden

[73] Assignee: AB Eiser, Borås, Sweden

[21] Appl. No.: 962,001

[22] Filed: Nov. 20, 1978

[30] Foreign Application Priority Data

Nov. 30, 1977 [SE] Sweden ..... 7713556

[51] Int. Cl.[2] ..... A41D 13/00

[52] U.S. Cl. ..... 2/81; 2/DIG. 1

[58] Field of Search ..... 2/81, 69, DIG. 1, 2; 165/46; 62/530

[56] References Cited

U.S. PATENT DOCUMENTS

| | | | |
|---|---|---|---|
| 3,643,463 | 2/1972 | Friedlander et al. | 2/81 X |
| 3,710,395 | 1/1973 | Spano et al. | 2/81 X |
| 3,783,451 | 1/1974 | Malin | 2/DIG. 1 |

FOREIGN PATENT DOCUMENTS

| | | | |
|---|---|---|---|
| 825256 | 12/1959 | United Kingdom | 2/DIG. 1 |

*Primary Examiner*—H. Hampton Hunter

*Attorney, Agent, or Firm*—Ernest A. Beutler

[57] ABSTRACT

A garment intended to be worn closest to the skin during vigorous physical activities in warm environments. The garment comprises a comparatively open warp knit fabric into the base of which are bound vertically extending cords. The warp knit fabric base is a mesh fabric consisting of thermo-settable synthetic fibres and is set to retain its shape, whereby it forces the cords to be displaced in parallel laterally upon movements, the cords being in contact with the skin. On account of its rigidity, the fabric provides an improved pumping effect upon relative movements between the garment and the body, thus improving the ventilation and carrying away of perspiration from the body. The garment has sufficient width to ensure that it is allowed to move unimpededly over the skin surface of the wearer.

6 Claims, 2 Drawing Figures

GARMENT FOR USE IN VIGOROUS PHYSICAL ACTIVITIES

BACKGROUND OF THE INVENTION

To dress correctly for different physical activities under different environmental circumstances and conditions has proved to be a very complex problem.

Physiologists have demonstrated what happens at different levels of physical activity, viz. the need for removal of moisture and heat or for insulation in order to achieve comfortable climatic conditions and to retain the working capacity. For instance, they have established that closest to the skin human beings have a thin layer of air, the so called microclimate which should be kept within a temperature range of between 30 and 33° C. to be felt as comfortable.

When the body is in motion, for instance during work and physical activites, excess heat is generated in the body which must be carried away at the rate it is generated, in order that it be possible to maintain a satisfactory level of performance and the ideal microclimate temperature. The conveyance of excess heat may be effected in various ways, two of the most important ones being air ventilation and perspiration.

To solve the problems involved in maintaining comfortable climatic conditions the design of the garment worn closest to the body is without comparison the most important one. Any tight-fitted knitted undergarment may be seen as a protection of the microclimate and prevents air ventilation closest to the skin. The Swedish Patent Specification No. 198,705 describes an undergarment which has a structure ensuring that the garment remains a certain distance from the skin, which makes possible unrestricted ventilation in a vertical direction in channels along the skin. The garment is intended for use during high-intensity activities in cold environments and is designed to make insulation possible during rest, and ventilation through vertical air through-flow, when the body is in motion. Coarse, vertical cords are joined together by very thin transverse threads which serve to prevent the vertical air flow as little as possible. The vertical cords thus will be positioned close to the body in fixed positions. In one case, an elastic thread is incorporated into the horizontal yarn system to definitely prevent the cords from moving on the skin surface. The cords thus serve to keep vertical channels open and to direct and to let out excess heat and moisture through the neck opening with the aid of thermal flows and interior ventilation. The pumping effect and ventilation during movements mentioned in said Specification are not caused by the undergarment as such but by the movements in the garment on top.

To improve the situation during vigorous physical activities in warm environments the ventilation, i.e. the exchange of air closest to the skin, must be increased. Any garment that clings to the skin makes air movements closest to the skin difficult to a smaller or larger extent, i.e. also in the case of close-fitting garments that are spaced from the body and comprise vertical cords.

SUMMARY OF THE INVENTION

The subject invention which is based on this knowledge, relates to a garment which is constructed in such a manner that when in use it induces motion of the microclimate and a rapid intermixture thereof with the surrounding air, and causes regulation of the effect in the desired manner in that (a) vertical cords are kept together on the inner face of a thermoset, comparatively rigid, open warp knit fabric in such a manner that the cord spacings are retained during relative movements between the garment and the skin surface, (b) the garment is given sufficient width to allow it to move freely and unrestrictedly over the skin surface, whereby the cords will be displaced in parallel laterally, while mechanically "working" (agitating) the microclimate, (c) that the rigidity of the base of the warp knit fabric, obtained through thermo-setting, also provides ventilation through a pumping effect during movements, (d) that this pumping effect may be modified by varying the density of the base of the warp knit fabric, the effect thus being adjusted to different environments and applications, and (e) that the density of the warp knit fabric base also may be adjusted to varying needs of protection against wind.

The garment in accordance with the invention is characterised in that the base of the warp knit fabric is a mesh fabric which consists of thermo-settable synthetic fibres and which is set to retain its shape so as to force the cords to be displaced in parallel laterally when the wearer moves, said cords being in contact with the skin, said fabric arranged, on account of its rigidity, to provide an improved pumping effect upon relative movement between the garment and the body, and in that the garment has a width sufficient to ensure its unimpeded movement over the skin surface of the wearer.

In the manner indicated, the garment in accordance with the invention actively influences the air circulation closest to the skin and may be used both as an undergarment worn under e.g. a working overall that allows movement of the undergarment, and as an outer garment worn closest to the skin during perspiration-inducing sport activities such as e.g. squash and tennis.

The construction of this garment and also its function thus are quite opposite to those of already known narrow-fitting garments designed to protect the microclimate, and the aim of this construction is to facilitate and increase air movements in the garment channels closely adjacent the skin.

As mentioned above, the garment in accordance with the invention should hang loosely on the body, similarly to a shirt. The base of the warp knit fabric keeps the cords apart laterally such that the latter—contrary to the principle put forward in the above-mentioned Swedish Patent Specification—are forced to move (slide) over the body surface during body movements and "agitate" the microclimate. In addition to the air exchange obtained as a result of the "pumping" effect obtained through the relative movements between the garment and the skin surface, one also obtains circulation and mixture of the air inside the microclimate air layer with the air surrounding the garment. The resulting effect is improved cooling through ventilation and air exchange as well as more rapid evaporation of the perspiration straight from the skin surface, all of which gives lower liquid losses from the body during vigorous physical activities.

The fibre material of the warp knit fabric should not be moisture-absorbing, as when used, the garment should not become wet through absorption of perspiration moisture.

BRIEF DESCRIPTION OF THE DRAWING

An undergarment in accordance with the subject invention, intended to be used closest to the body, is illustrated in the accompanying drawing, wherein.

DETAILED DESCRIPTION OF A PREFERRED EMBODIMENT

Figure 1:
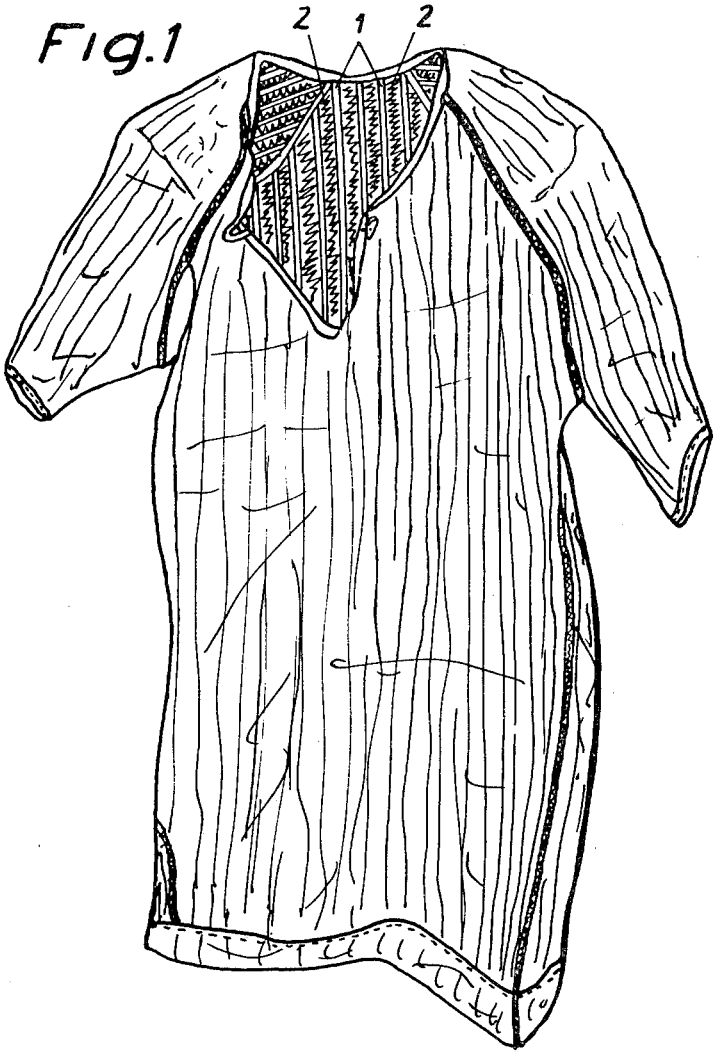
FIG. 1 is a front view of the garment.
Figure 2:
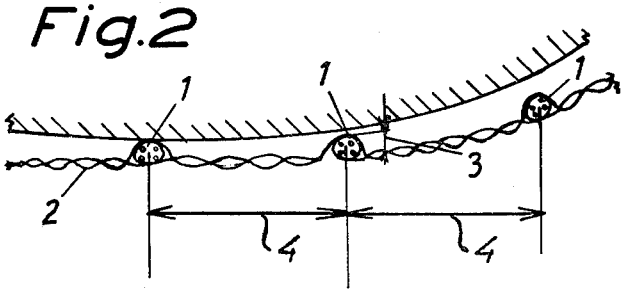
FIG. 2 illustrates on an enlarged scale, a horizontal cross-section through a part of the garment close to the body of the wearer.

The invention will be described in closer detail in the following with reference to the embodiment illustrated in the drawing.

The material of the garment consists of a comparatively open warp knit fabric which is arranged to retain its shape and which comprises vertical cords 1 bound into the base 2 of the warp knit fabric. The height 3 of the cords 1 is appr. 2 to 2.5 mm and the distance 4 between the cords appr. 5 to 8 mm, preferably appr. 7 mm. The cords 1 consist of several threads, e.g. four threads, each of a kind denominated Nm 34/2, i.e. having a size of appr. 500 deniers. The threads of the cords 1 preferably consist of a spun yarn of polyester, polypropylene, acryl or polychlal or a mixture of these synthetic materials.

The yarn of the warp knit fabric base 2 has a size of appr. 150 deniers. It preferably consists of a texturized yarn of polyester or polyamide or a mixture of these two synthetic materials.

Because the cords 1 are to be kept apart while the garment is worn, which requires a certain degree of rigidity, the fabric is a warp knit fabric. The latter preferably is produced in a two-bar warp loom, i.e. a Raschel loom or a warp frame comprising two needle bars. The openness of the fabric, i.e. the mesh spacings, is adjusted to the demands on the desired degree of protection against wind, i.e. whether the garment is intended to be used under windy or calm conditions.

When the garment is intended to be used under extremely windy weather conditions it is of course possible to wear a wind-protecting garment on top of the undergarment, the latter being worn closest to the skin.

What we claim is:

1. An improved garment intended to be worn closest to the skin during vigorous physical activities in warm environments, said garment comprising a comparatively open warp knit fabric base and vertically extending cords bound into said base, the improvement comprising the base of said warp knit fabric being a mesh fabric, said fabric comprising thermo-settable synthetic fibres, said fabric set to retain its shape so as to force said cords to be displaced in parallel laterally when the wearer of the garment moves, said cords being in contact with the skin, said fabric arranged, on account of its rigidity, to provide an improved pumping effect upon relative movements between said garment and the wearer's body, said garment having a width sufficient to ensure its unimpeded movement over the skin surface of the wearer.

2. An improved garment as claimed in claim 1, wherein the height of said cords is appr. 2 to 2.5 millimeters and the spacings between neighbouring cords appr. 5 to 8 millimeters, preferably about 7 millimeters.

3. An improved garment as claimed in claim 1, wherein the material of said cords is a spun yarn chosen from the group comprising polyester, polypropylene, acryl and polychlal.

4. An improved garment as claimed in claim 1, wherein the material of said cords is a mixture of any one of the materials of the group comprising polyester, polypropylene, acryl, and polychlal.

5. An improved garment as claimed in claim 1, wherein the material of said base of the knit fabric is a texturized, thermo-settable yarn chosen from the group consisting of polyester and polyamide.

6. An improved garment as claimed in claim 1, wherein the material of said base of the knit fabric is a texturized, thermo-settable yarn, said yarn being a mixture of polyester and polyamide.

* * * * *